US007050030B2

(12) United States Patent
Willis

(10) Patent No.: US 7,050,030 B2
(45) Date of Patent: May 23, 2006

(54) FLICKER REDUCTION BY DISPLAY POLARITY INTERLEAVING

(75) Inventor: Donald Henry Willis, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 261 days.

(21) Appl. No.: 10/099,034

(22) Filed: Mar. 14, 2002

(65) Prior Publication Data

US 2002/0167509 A1 Nov. 14, 2002

Related U.S. Application Data

(60) Provisional application No. 60/290,880, filed on May 14, 2001.

(51) Int. Cl.
*G09G 3/36* (2006.01)

(52) U.S. Cl. ..... 345/96; 345/204; 345/209

(58) Field of Classification Search ..... 345/7–9, 345/87–104, 204–212, 690–699
See application file for complete search history.

(56) References Cited

U.S. PATENT DOCUMENTS

| | | | | |
|---|---|---|---|---|
| 5,673,059 | A * | 9/1997 | Zavracky et al. | 345/8 |
| 5,805,126 | A * | 9/1998 | Bassetti | 345/89 |
| 5,963,192 | A * | 10/1999 | Wong et al. | 345/593 |
| 6,097,352 | A * | 8/2000 | Zavracky et al. | 345/7 |
| 6,108,122 | A * | 8/2000 | Ulrich et al. | 359/291 |
| 6,151,001 | A * | 11/2000 | Anderson et al. | 345/63 |
| 2002/0067337 | A1* | 6/2002 | Klink | 345/156 |
| 2002/0126218 | A1* | 9/2002 | Willis | 348/459 |

* cited by examiner

*Primary Examiner*—Vijay Shankar
(74) *Attorney, Agent, or Firm*—Joseph J. Laks; Harvey D. Fried; Christine Johnson

(57) ABSTRACT

A flicker reduction system (20) for an imager (24) having random row access includes a memory (22) coupled to the imager and a controller (26) coupled to the memory and the imager. Preferably, the controller is programmed to interleave stripes (12, 14, 16, 18) of opposing polarity on the imager for a current frame, wherein each stripe has a plurality of horizontal lines and further programmed to overwrite the plurality of horizontal lines in each stripe for a subsequent frame with another plurality of horizontal lines having an opposing polarity to the plurality of horizontal lines for the current frame.

20 Claims, 3 Drawing Sheets

FLICKER REDUCTION BY DISPLAY POLARITY INTERLEAVING

CROSS REFERENCE TO RELATED APPLICATIONS

This is a non-provisional application of provisional application Ser. No. 60/290,880 filed May 14, 2001.

BACKGROUND OF THE INVENTION

1. Field of the Invention

The invention arrangements relate to the field of LCOS (liquid crystal on silicon) and/or LCD (liquid crystal display) video display systems, both reflective and transmissive and more particularly to a method and system of reducing flicker on such video display systems.

2. Description of Related Art

Liquid crystal on silicon (LCOS) can be thought of as one large liquid crystal formed on a silicon wafer. The silicon wafer is divided into an incremental array of tiny plate electrodes. A tiny incremental region of the liquid crystal is influenced by the electric field generated by each tiny plate and the common plate. Each such tiny plate and corresponding liquid crystal region are together referred to as a cell of the imager. Each cell corresponds to an individually controllable pixel. A common plate electrode is disposed on the other side of the liquid crystal. Each cell, or pixel, remains lighted with the same intensity until the input signal is changed, thus acting as a sample and hold (so long as the voltage is maintained, the pixel brightness does not decay). The pixel does not decay, as is the case with the phosphors in a cathode ray tube. Each set of common and variable plate electrodes forms an imager. One imager is provided for each color, in this case, one imager each for red, green and blue.

It is typical to drive the imager of an LCOS display with a frame-doubled signal to avoid 30 Hz flicker, by sending first a normal frame in which the voltage at the common electrode is positive with respect to the voltage at the electrodes associated with each cell (positive picture) and then an inverted frame in which voltage at the common electrode is negative with respect to the voltage at the electrodes associated with each cell (negative picture) in response to a given input picture. The generation of positive and negative pictures ensures that each pixel will be written with a positive electric field followed by a negative electric field. The resulting drive field has a zero DC component, which is necessary to avoid the image sticking, and ultimately, permanent degradation of the imager. It has been determined that the human eye responds to the average value of the brightness of the pixels produced by these positive and negative pictures so long as the frame rate is at or above 120 Hertz.

The drive voltages are supplied to plate electrodes on each side of the LCOS array. In the presently preferred LCOS system to which the inventive arrangements pertain, the common plate is always at a potential of about 8 volts. This voltage can be adjustable. Each of the other plates in the array of tiny plates is operated in two voltage ranges. For positive pictures, the voltage varies between 0 volts and 8 volts. For negative pictures the voltage varies between 8 volts and 16 volts.

The light supplied to the imager, and therefore supplied to each cell of the imager, is field polarized. Each liquid crystal cell rotates the polarization of the input light responsive to the root mean square (RMS) value of the electric field applied to the cell by the plate electrodes. Generally speaking, the cells are not responsive to the polarity (positive or negative) of the applied electric field. Rather, the brightness of each pixel's cell is generally only a function of the rotation of the polarization of the light incident on the cell. As a practical matter, however, it has been found that the brightness can vary somewhat between the positive and negative field polarities for the same polarization rotation of the light. Such variation of the brightness can cause an undesirable flicker in the displayed picture.

In this embodiment, in the case of either positive or negative pictures, as the field driving the cells approaches a zero electric field strength, corresponding to 8 volts, the closer each cell comes to white, corresponding to a full on condition. Other systems are possible, for example where the common voltage is set to 0 volts. It will be appreciated that the inventive arrangements taught herein are applicable to all such positive and negative field LCOS imager driving systems.

Pictures are defined as positive pictures when the variable voltage applied to the tiny plate electrodes is less than the voltage applied to the common plate electrode, because the higher the tiny plate electrode voltage, the brighter the pixels. Conversely, pictures are defined as negative pictures when the variable voltage applied to the tiny plate electrodes is greater than the voltage applied to the common plate electrode, because the higher the tiny plate electrode voltage, the darker the pixels. The designations of pictures as positive or negative should not be confused with terms used to distinguish field types in interlaced video formats.

The present state of the art in LCOS requires the adjustment of the common-mode electrode voltage, denoted VITO, to be precisely between the positive and negative field drive for the LCOS. The subscript ITO refers to the material indium tin oxide. The average balance is necessary in order to minimize flicker, as well as to prevent a phenomenon known as image sticking.

In order to avoid visible flicker, it is common practice to use a higher vertical scanning frequency, or frame rate, to reduce the visibility of flicker. In an NTSC system, for example, a frame rate of 60 Hz can be doubled to a frame rate of 120 Hz to render the flicker less visible. In a PAL system, a field rate of 50 Hz can be doubled to a field rate of 100 Hz. However, the higher frame rate or field rate makes adjustment of the common mode electrode voltage more difficult because the flicker is not visible to the human eye. An operator cannot make the necessary adjustments without special instruments.

Faster frame rates have required frame rate doublers, that is, a circuit that can cause each picture to be scanned twice within each frame period of the incoming video signal. A 60 Hz frame rate has a frame period of 1/60 second. Doubling a frame rate of 60 Hz requires scanning at 120 Hz. A 120 Hz frame rate has a frame period of 1/120 second. If an incoming video signal has a horizontal scanning frequency of 2 $f_H$, where $f_H$ is for example a standard NTSC horizontal scanning rate, and a standard frame rate of 60 Hz, the pictures must be displayed at 4 $f_H$ and 120 Hz. In other words, each picture must be displayed twice during each 60 Hz frame period, that is, displayed twice in every 1/60 second. Each line must be written to the display at 4 $f_H$. Although frame rate multipliers can solve flicker problems, such solution comes with many associated detriments. For example, a solution using frame rate doubling typically requires an additional frame of memory, additional pins in a device package that reads from the memory, additional real estate on a printed circuit board incorporating such circuitry, and additional compensation for handling any generated radiation associated with the frame rate doubling. All these associated detriments involve added expense in a consumer-oriented product sensitive to such additional cost factors.

There is a clear need to ameliorate the flicker problem without the expense and complexity of frame rate multipliers, such as frame rate doublers.

SUMMARY OF THE INVENTION

The present invention solves the prior art need to substantially reduce flicker without implementing frame rate multipliers.

Flicker visibility in an LCOS display can be reduced in accordance with the inventive arrangements by displaying positive and negative regions of pixels, for example horizontal stripes of rows in the LCOS imager, at the same time.

In one aspect of the invention, a method of flicker reduction in an imager having random row access comprises the steps of interleaving stripes of opposing polarity on the imager for a current frame, wherein each stripe has a plurality of horizontal lines and overwriting the plurality of horizontal lines in each stripe for a subsequent frame with another plurality of horizontal lines having an opposing polarity to the plurality of horizontal lines for the current frame.

In another aspect of the invention, a flicker reduction system for an imager having random row access comprises a memory coupled to the imager and a controller coupled to the memory and the imager. Preferably, the controller is programmed to interleave stripes of opposing polarity on the imager for a current frame, wherein each stripe has a plurality of horizontal lines and programmed to overwrite the plurality of horizontal lines in each stripe for a subsequent frame with another plurality of horizontal lines having an opposing polarity to the plurality of horizontal lines for the current frame.

In yet another aspect of the present invention, a method for reducing flicker in an imager comprises the steps of energizing pixels in the imager in accordance with an interleaved arrangement of first and second groups of horizontal lines, using electrical fields of a first polarity for the first group and using electrical fields of a second polarity for the second group. The method further comprises the step of periodically reversing the first and second polarities of the fields used for energizing said first and second groups. The step of periodically reversing can further comprise the step of reversing the first and second polarities each time each of the horizontal lines is overwritten. The method can also comprise the step of overwriting each of the horizontal lines during each image writing interval for a video signal driving the imager. The method could also comprise the step of reversing the first and second polarities during each image writing interval for a video signal driving the imager.

DETAILED DESCRIPTION OF THE PREFERRED EMBODIMENTS

Figure 1:
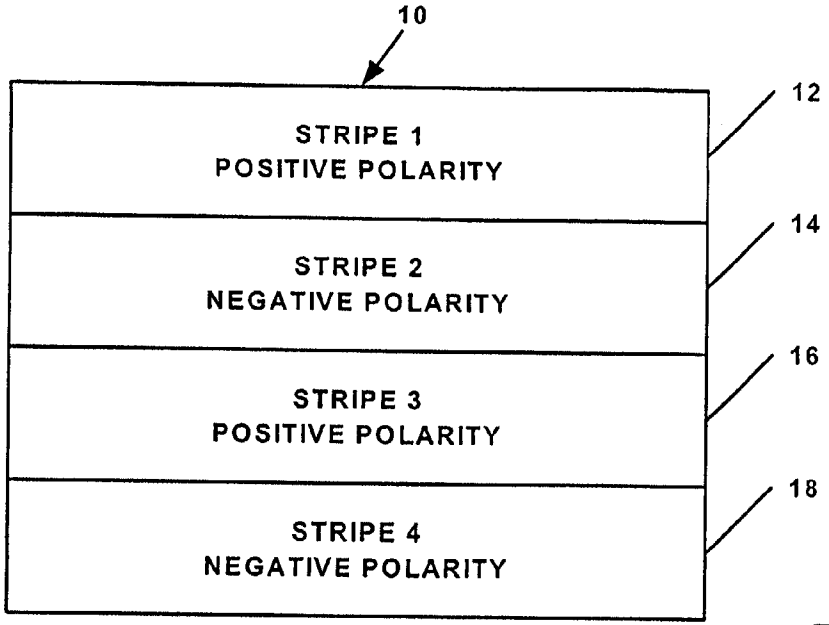
FIG. 1 is a diagram of a liquid crystal imager, for example an LCOS imager, divided into four stripes in accordance with the inventive arrangements.

FIG. 1 is a diagram illustrating how an LCOS imager 10 can be divided in a plurality of horizontal stripes, for example four stripes 12, 14, 16 and 18. If the imager is, for example, a 480 line (row) display, then each stripe contains 120 lines. The polarity of the stripes alternates, and as shown in FIG. 1, stripe 1 (12) is positive, stripe 2 (14) is negative, stripe 3 (16) is positive and stripe 4 (18) is negative.

Figure 2:
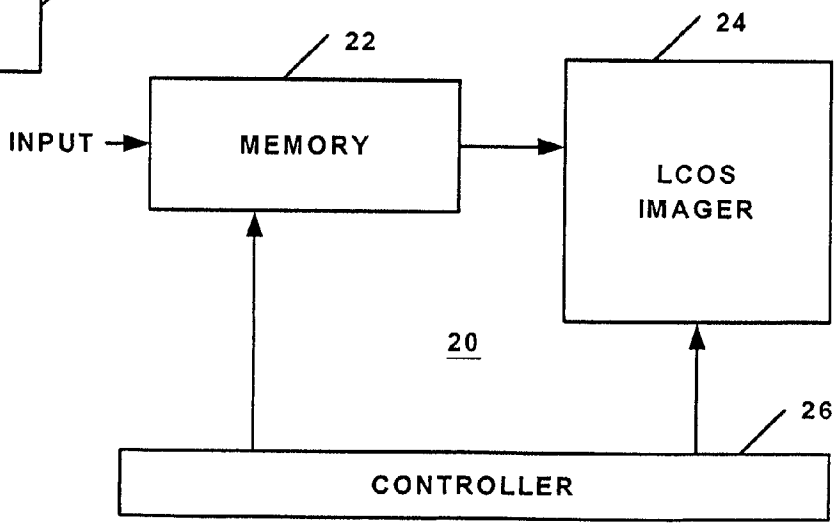
FIG. 2 is a block diagram of a video processing system for implementing the inventive arrangements.

With further reference to FIG. 2, as the input signal enters a video processing system 20, the signal is written into a memory 22, for example a frame memory. When the memory is full enough of a given picture, for example 80%, then the display of that picture can begin. Assuming the same 480 line display, line 361 in stripe 4 can be read out of the memory and written first as a positive row, overwriting the first row of stripe 4, which was negative. Next, line 241 can be read out of the memory and written to the display as a negative row, overwriting the first row of stripe 3, which was positive. Next, line 121 can be read out of the memory and written to the display as a positive row, overwriting the negative first row of stripe 2. Next, line 1 can be read out of the memory and written to the display as a negative row, overwriting the first positive row of stripe 1. Next, line 362 is read out of the memory and written to the display as a positive row, overwriting the second row of stripe 4. This process continues until all rows in all stripes are overwritten. At this point stripes 2 and 4 are positive pixels and stripes 1 and 3 are negative pixels. The memory is again 80% full of the next picture. Now the overwriting of the first picture can begin, but this time stripes 2 and 4 will be overwritten with negative pixels and stripes 1 and 3 will be overwritten with positive pixels.

The writing of the stripes can occur in any "4's" rotation, for example, 1 2 3 4, 4 3 2 1, etc. Different numbers of stripes can also be used, for example, 2, 6 and 8.

The stripes must have alternating polarities. Different numbers of stripes require different rotations.

The boundaries between lines of opposite polarity are subject to disclination errors due to large voltage differences, but since these voltage differences only exist for 2, 4, 6 or 8 line periods, for example, this does not present a practical problem due to the relatively slow response of the liquid crystals. In other words, although polarity differences (with large voltage differences) on adjacent rows could exist, the relatively short time that they exist avoids most or all visible disclination errors. It should be noted that the largest voltage differences would typically exist between lines already written and the adjacent lines to be written. For example, when line 121 is read out of the memory and written to the display as a positive row, overwriting the negative first row of stripe 2 as described above, line 121 will have a polarity different (and hence, a large voltage difference) with line 122 (currently, the negative second row of stripe 2) which has yet to be written to the display as a positive row. The memory can advantageously be read out more slowly than written to avoid having a long delay during the vertical blanking interval between each frame. The pixels of each progressive frame are advantageously written only once, but the alternating character of the display with respect to positive and negative pixels tends to substantially eliminate perceptible flicker without a frame rate multiplier.

Figure 3:
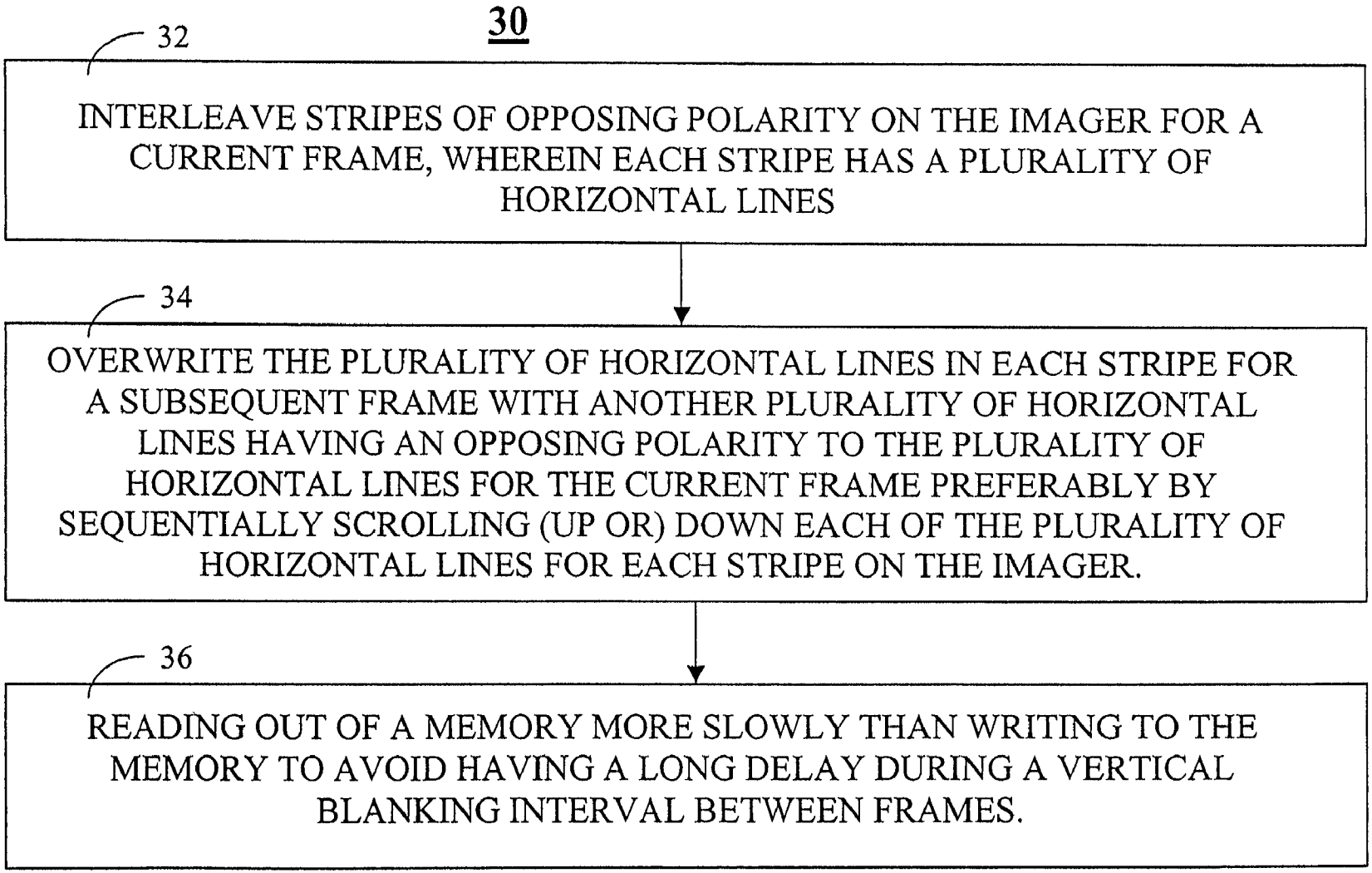
FIG. 3 is a flow chart illustrating a method of flicker reduction in accordance with the present invention.

Referring to FIG. 3, a flow chart illustrating a method 30 for reducing flicker in an imager having random row access is shown. The method preferably comprises the steps of interleaving (32) stripes of opposing polarity on the imager for a current frame, wherein each stripe has a plurality of horizontal lines and overwriting (34) the plurality of horizontal lines in each stripe for a subsequent frame with another plurality of horizontal lines having an opposing polarity to the plurality of horizontal lines for the current frame.

Preferably, the step of overwriting comprises the step of sequentially scrolling down (or up) each of the plurality of horizontal lines for each stripe on the imager simultaneously. As described above, the current frame and the subsequent frames each have pictures that are preferably one half positive polarity and one-half negative polarity at a normal frame rate, although the present invention is not necessarily limited thereto. Also, as previously described, the current frame is preferably divided into four horizontal stripes having a first stripe of positive polarity, a second stripe of negative polarity, a third stripe of positive polarity, and a fourth stripe of negative polarity and a subsequent frame is divided into four horizontal stripes having a first stripe of negative polarity overwriting the first stripe of positive polarity, a second stripe of positive polarity overwriting the second stripe of negative polarity, a third stripe of negative polarity overwriting the third stripe of positive polarity, and a fourth stripe of positive polarity overwriting the fourth stripe of negative polarity. At step 36, the method can further comprise the step of reading out of a memory more slowly than writing to the memory to avoid having a long delay during a vertical blanking interval between frames.

Although the present invention has been described in conjunction with the embodiments disclosed herein, it should be understood that the foregoing description is intended to illustrate and not limit the scope of the invention as defined by the claims.

Figure 4:
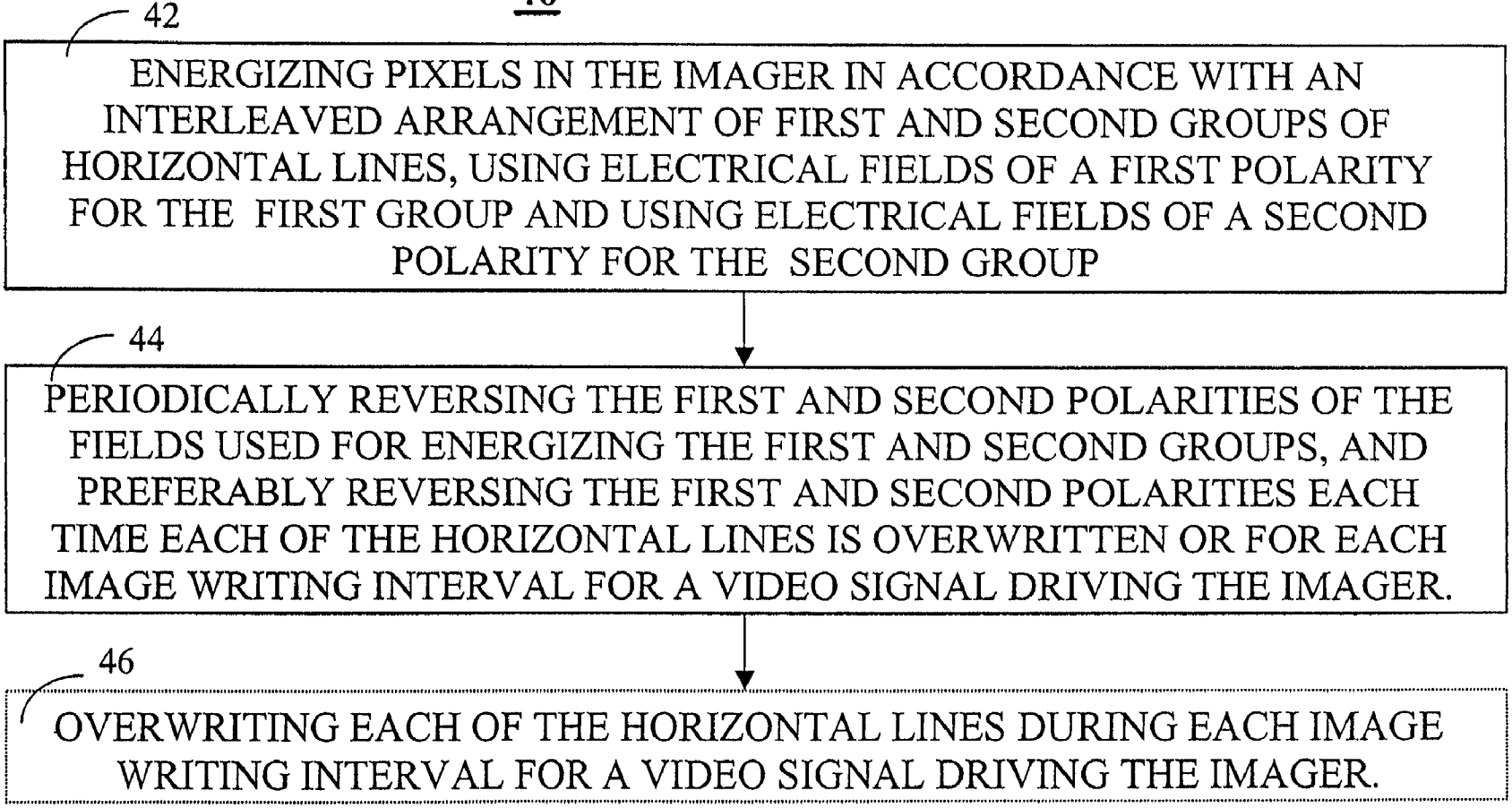
FIG. 4 is a flow chart illustrating a method for reducing flicker in an imager in accordance with the present invention.

Referring to FIG. 4, a flow chart illustrating a method 40 for reducing flicker in an imager is shown. At step 42, pixels in the imager are energized in accordance with an interleaved arrangement of first and second groups of horizontal lines, using electrical fields of a first polarity for the first group and using electrical fields of a second polarity for the second group. The method continues at step 44 by periodically reversing the first and second polarities of the fields used for energizing the first and second groups, and preferably by reversing the first and second polarities each time each of the horizontal lines is overwritten or for each imager writing interval for a video signal driving the imager. Optionally, the method 40 may further comprise the step 46 of overwriting each of the horizontal lines during each image writing interval for a video signal driving the imager.

What is claimed is:

1. A flicker reduction system for an imager having random row access, comprising:

a memory coupled to the imager; and a controller coupled to the memory and the imager, wherein the controlled is programmed to:

interleave stripes of opposing polarity on the imager for a current frame, wherein each stripe has a plurality of horizontal lines; and overwrite the plurality of horizontal lines in each stripe for a subsequent frame with another plurality of horizontal lines having an opposing polarity to the plurality of horizontal lines for the current frame.

2. The system of claim 1, wherein the controller is programmed in the step of overwriting to sequentially scroll down each of the plurality of horizontal lines for each stripe on the imager.

3. The system of claim 1, wherein the controller is programmed in the step of overwriting to sequentially scroll up each of the plurality of horizontal lines for each stripe on the imager.

4. The system of claim 1, wherein the current frame and the subsequent frames each have pictures that are one half positive polarity and one-half negative polarity at a normal frame rate.

5. The system of claim 1, wherein the current frame is divided into four horizontal stripes having a first stripe of positive polarity, a second stripe of negative polarity, a third stripe of positive polarity, and a fourth stripe of negative polarity.

6. The system of claim 5, wherein the subsequent frame is divided into four horizontal stripes having a first stripe of negative polarity overwriting the first stripe of positive polarity, a second stripe of positive polarity overwriting the second stripe of negative polarity, a third stripe of negative polarity overwriting the third stripe of positive polarity, and a fourth stripe of positive polarity overwriting the fourth stripe of negative polarity.

7. The system of claim 1, wherein the imager is a liquid crystal on silicon (LCOS) imager.

8. The system of claim 1, wherein the controller is further programmed in the step of overwriting to simultaneously overwrite a corresponding row for each stripe in a sequential scrolling manner.

9. A method for reducing flicker in an imager, comprising the steps of:

energizing pixels in said imager in accordance with an interleaved arrangement of first and second groups of horizontal lines, using electrical fields of a first polarity for said first group and using electrical fields of a second polarity for said second group; and, periodically reversing said first and second polarities of said fields used for energizing said first and second groups.

10. The method of claim 9, wherein the step of periodically reversing further comprises reversing said first and second polarities each time each of said horizontal lines is overwritten.

11. The method of claim 10, comprising the step of overwriting each of said horizontal lines during each image writing interval for a video signal driving said imager.

12. The method of claim 9, comprising the step of reversing said first and second polarities during each image writing interval for a video signal driving said imager.

13. A method of flicker reduction in an imager having random row access, comprising the steps of:

interleaving stripes of opposing polarity on the imager for a current frame, wherein each stripe has a plurality of horizontal lines; and overwriting the plurality of horizontal lines in each stripe for a subsequent frame with another plurality of horizontal lines having an opposing polarity to the plurality of horizontal lines for the current frame.

14. The method of claim 13, wherein the step of overwriting comprises the step of sequentially scrolling down each of the plurality of horizontal lines for each stripe on the imager.

15. The method of claim 13, wherein the step of overwriting comprises the step of sequentially scrolling up each of the plurality of horizontal lines for each stripe on the imager.

16. The method of claim 13, wherein the current frame and the subsequent frames each have pictures that are one half positive polarity and one-half negative polarity at a normal frame rate.

17. The method of claim 13, wherein the current frame is divided into four horizontal stripes having a first stripe of positive polarity, a second stripe of negative polarity, a third stripe of positive polarity, and a fourth stripe of negative polarity.

18. The method of claim 17, wherein the subsequent frame is divided into four horizontal stripes having a first stripe of negative polarity overwriting the first stripe of positive polarity, a second stripe of positive polarity overwriting the second stripe of negative polarity, a third stripe of negative polarity overwriting the third stripe of positive polarity, and a fourth stripe of positive polarity overwriting the fourth stripe of negative polarity.

19. The method of claim 13, wherein the method further comprises the step of reading out of a memory more slowly than writing to the memory to avoid having a long delay during a vertical blanking interval between frames.

20. The method of claim 13, wherein the step of overwriting comprises overwriting a corresponding row for each stripe in a sequential scrolling manner.

* * * * *